US011225796B2

(12) United States Patent
Lenney

(10) Patent No.: US 11,225,796 B2
(45) Date of Patent: Jan. 18, 2022

(54) RAISED ARC RAIN GUTTER DEBRIS PRECLUSION DEVICE

(71) Applicant: GutterGlove, Inc., Roseville, CA (US)

(72) Inventor: Robert C. Lenney, Lincoln, CA (US)

(73) Assignee: GUTTERGLOVE, INC., La Vergne, TN (US)

( * ) Notice: Subject to any disclaimer, the term of this patent is extended or adjusted under 35 U.S.C. 154(b) by 0 days.

(21) Appl. No.: 17/109,116

(22) Filed: Dec. 1, 2020

(65) Prior Publication Data

US 2021/0087817 A1 Mar. 25, 2021

Related U.S. Application Data

(63) Continuation of application No. 16/182,438, filed on Nov. 6, 2018, now Pat. No. 10,858,837, which is a continuation of application No. 15/068,788, filed on Mar. 14, 2016, now Pat. No. 10,125,496, which is a continuation of application No. 14/620,965, filed on Feb. 12, 2015, now abandoned, which is a continuation of application No. 13/998,004, filed on Sep. 23, 2013, now abandoned, which is a continuation of application No. 13/624,671, filed on Sep. 21, 2012, now abandoned.

(60) Provisional application No. 61/537,459, filed on Sep. 21, 2011.

(51) Int. Cl.

| | |
|---|---|
| ***E04D 13/00*** | (2006.01) |
| ***E04D 13/076*** | (2006.01) |
| ***E04D 13/064*** | (2006.01) |
| ***E04D 13/072*** | (2006.01) |

(52) U.S. Cl.

CPC ..... *E04D 13/076* (2013.01); *E04D 13/064* (2013.01); *E04D 13/0725* (2013.01); *E04D 13/0727* (2013.01); *E04D 13/0767* (2013.01)

(58) Field of Classification Search

CPC ..... E04D 13/064; E04D 13/0725; E04D 13/0727; E04D 13/076; E04D 13/0767; E03F 5/0404; E03F 5/14

USPC ..... 52/11, 12, 14, 15; 210/162, 163

See application file for complete search history.

(56) References Cited

U.S. PATENT DOCUMENTS

| | | | | | |
|---|---|---|---|---|---|
| 1,732,058 | A | * | 10/1929 | Martini | E04D 13/076 210/474 |
| 2,229,381 | A | * | 1/1941 | Grow | E04D 13/076 52/12 |
| 2,288,121 | A | * | 6/1942 | Sandmeyer | E04D 13/076 52/12 |
| 2,583,422 | A | * | 1/1952 | Haddon | E04D 13/076 210/498 |
| 3,691,343 | A | * | 9/1972 | Norman | H05B 3/00 219/213 |
| 4,308,696 | A | * | 1/1982 | Schroeder | E04D 13/0762 219/213 |

(Continued)

*Primary Examiner* — Brian E Glessner
*Assistant Examiner* — James J Buckle, Jr.
(74) *Attorney, Agent, or Firm* — Jonathan Kidney; Glen L. Gross; Intelink Law Group, P.C.

(57) ABSTRACT

A gutter debris preclusion device for use with a gutter attached to a building, comprising a support structure being substantially rigid and having a recess with a plurality of apertures and a plurality of ribs; a screen having a plurality of apertures and being at least partially disposed on the ribs of the support structure; and, wherein a cross-sectional profile of the screen has an arc shape.

7 Claims, 11 Drawing Sheets

(56) References Cited

U.S. PATENT DOCUMENTS 4,435,466 A * 3/1984 Kuhnel ..... C08K 3/36 428/215
4,646,488 A * 3/1987 Burns ..... E04D 13/0459 52/12
4,745,710 A * 5/1988 Davis ..... E04D 13/076 210/473
4,755,229 A * 7/1988 Armanini ..... C09C 1/0015 106/413
4,769,526 A * 9/1988 Taouil ..... E04D 13/0762 219/213
4,827,886 A * 5/1989 Maeda ..... F02P 7/067 123/476
4,949,514 A * 8/1990 Weller ..... E04D 13/076 210/474
5,010,696 A * 4/1991 Knittel ..... E04D 13/076 210/474
5,044,581 A * 9/1991 Dressler ..... E04D 13/076 248/48.1
5,107,635 A * 4/1992 Carpenter ..... E04D 13/076 210/474
5,127,200 A * 7/1992 Doran ..... E04D 13/076 15/160
5,261,195 A * 11/1993 Buckenmaier ..... E04D 13/0459 52/94
5,325,090 A * 6/1994 Goeldner ..... H04L 12/5601 340/2.22
5,391,858 A * 2/1995 Tourangeau ..... E04D 13/0762 165/47
5,398,464 A * 3/1995 Jacobs ..... E04D 13/076 248/48.1
5,406,754 A * 4/1995 Cosby ..... E04D 13/076 52/12
5,558,705 A * 9/1996 Keemer ..... C09B 63/00 106/403
5,617,678 A * 4/1997 Morandin ..... E04D 13/0725 248/48.2
5,640,809 A * 6/1997 Iannelli ..... E04D 13/076 210/474
5,729,931 A * 3/1998 Wade ..... E04D 13/076 52/12
5,759,255 A * 6/1998 Venturini ..... C09C 1/0015 106/418
5,878,533 A * 3/1999 Swanfeld, Jr. ..... E04D 13/0762 52/11
6,134,843 A * 10/2000 Tregear ..... E04D 13/076 210/474
6,194,049 B1 * 2/2001 Bindschedler-Galli ..... B32B 27/08 428/76
6,194,519 B1 * 2/2001 Blalock ..... C08L 23/0815 525/232
6,205,715 B1 * 3/2001 Rex, Jr. ..... E04D 13/076 52/12
6,225,600 B1 * 5/2001 Burris ..... E04D 13/0762 219/213
6,341,462 B2 * 1/2002 Kiik ..... E04D 1/20 52/518
6,607,781 B2 * 8/2003 Joedicke ..... C09C 1/3661 427/186
6,700,098 B1 * 3/2004 Wyatt ..... E04D 13/0762 219/213
6,708,452 B1 * 3/2004 Tenute ..... E04D 13/0762 219/213
6,759,630 B1 * 7/2004 Tenute ..... E04D 13/103 219/213
6,942,419 B2 * 9/2005 Knak ..... E03F 5/06 210/163
6,951,077 B1 * 10/2005 Higginbotham ..... E04D 13/076 210/499
6,959,512 B2 * 11/2005 Cobb ..... E04D 13/0481 219/213
7,104,012 B1 * 9/2006 Bayram ..... E04D 13/076 219/213
7,191,564 B2 * 3/2007 Higginbotham ..... E04D 13/076 210/474
7,624,541 B2 * 12/2009 Gentry ..... E04D 13/076 248/48.1
7,975,435 B2 * 7/2011 Lenney ..... E04D 13/076 52/12
8,033,058 B2 * 10/2011 Block ..... E04D 13/08 52/12
2003/0046876 A1 * 3/2003 Higginbotham ..... E04D 13/076 52/11
2003/0198736 A1 * 10/2003 Fensel ..... D06N 5/00 427/186
2005/0072114 A1 * 4/2005 Shiao ..... E04D 1/00 52/782.1
2005/0279036 A1 * 12/2005 Brochu ..... E04D 13/0643 52/287.1
2006/0037252 A1 * 2/2006 Gosse ..... E04D 13/0762 52/11
2006/0117670 A1 * 6/2006 Tsioris ..... E04D 13/076 52/11
2006/0123710 A1 * 6/2006 Lenney ..... E04D 13/076 52/12
2006/0156636 A1 * 7/2006 Walker ..... E04D 13/0725 52/11
2006/0179723 A1 * 8/2006 Robins ..... E04D 13/076 52/11
2006/0196124 A1 * 9/2006 Bachman ..... E04D 13/0762 52/12
2006/0213129 A1 * 9/2006 Bachman ..... E04D 13/0762 52/11
2006/0277831 A1 * 12/2006 Bachman ..... E04D 13/0762 52/11
2006/0283096 A1 * 12/2006 Bachman ..... E04D 13/076 52/11
2007/0054129 A1 * 3/2007 Kalkanoglu ..... E04D 5/08 428/413
2007/0065640 A1 * 3/2007 Joedicke ..... C04B 20/12 428/143
2007/0094939 A1 * 5/2007 Bachman ..... E04D 13/0762 52/11
2007/0199276 A1 * 8/2007 Duque ..... F16B 15/00 52/741.4
2007/0218251 A1 * 9/2007 Jacobs ..... B32B 27/14 428/143
2007/0234647 A1 * 10/2007 Higginbotham .... E04D 13/0765 52/12
2007/0246449 A1 * 10/2007 Bachman ..... E04D 13/0762 219/213
2008/0187708 A1 * 8/2008 Decker ..... C09D 7/41 428/98
2008/0248241 A1 * 10/2008 Kalkanoglu ..... B32B 11/10 428/141
2009/0056234 A1 * 3/2009 Brochu ..... E04D 13/076 52/12
2009/0064628 A1 * 3/2009 Mellott, II ..... B32B 5/024 52/717.05
2010/0042579 A1 * 2/2010 Larsen ..... G06F 16/00 711/163
2010/0287846 A1 * 11/2010 Lenney ..... E04D 13/0762 52/12
2011/0067318 A1 * 3/2011 Lenney ..... E04D 13/076 52/12
2012/0042579 A1 * 2/2012 McCoy ..... E04D 13/076 52/12

* cited by examiner

FIG. 1
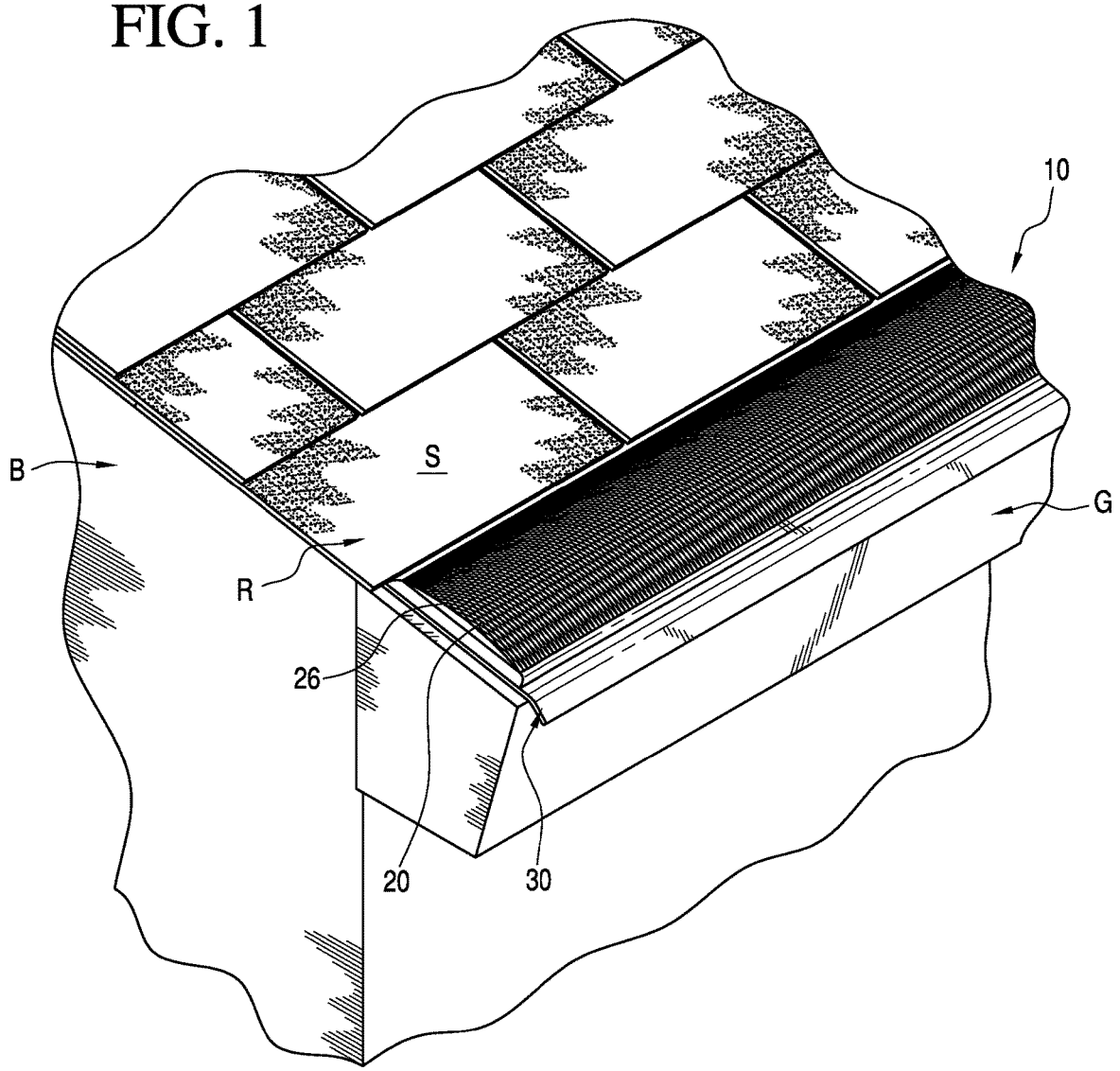
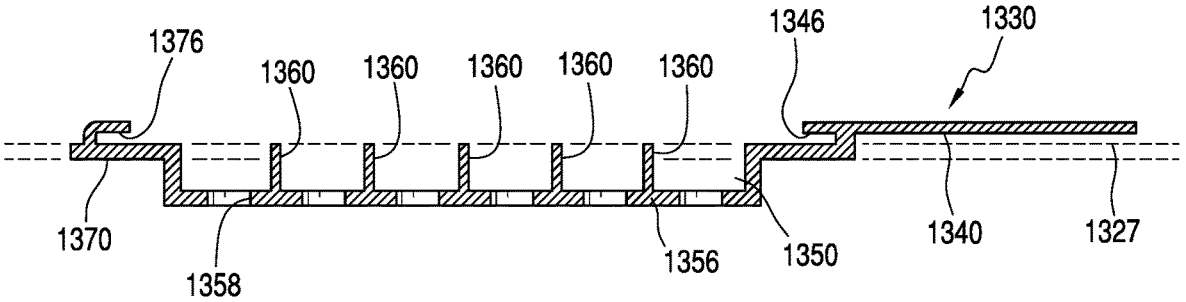
FIG. 2
(PRIOR ART)

RAISED ARC RAIN GUTTER DEBRIS PRECLUSION DEVICE

CROSS REFERENCE TO RELATED APPLICATION

This application is a continuation of U.S. application Ser. No. 14/620,965 filed on Feb. 12, 2015, which is a continuation of U.S. application Ser. No. 13/998,004 filed on Sep. 23, 2013, which is a continuation of U.S. application Ser. No. 13/624,671 filed on Sep. 21, 2012, which is a nonprovisional application of U.S. Provisional Application No. 61/537,459 filed on Sep. 21, 2011; and this application claims priority to all of the above-identified applications and all of the above-identified applications are incorporated herein by reference in their respective entireties.

BACKGROUND OF THE INVENTION

1. Field of Invention

This invention relates to barriers for rain gutters and similar structures for keeping leaves and other debris out of the rain gutters. More particularly, this invention relates to rain gutter debris preclusion barriers, which utilize a screen to allow water to pass into the gutter, but preclude debris from passing through the screen and into the gutter.

2. Description of Related Art

Prior gutter debris preclusion devices have been effective in preventing debris from passing through the screen and entering the gutter. Such devices are disclosed in U.S. Pat. No. 7,310,912, (the '912 patent) issued to Robert C. Lenney and John Lewis. U.S. Pat. No. 7,310,912 is incorporated herein in its entirety by reference.

Despite the effectiveness of the devices taught by the '912 patent, there are still areas for enhancement and modification to those devices. The present invention addresses some of these areas for modification, such as in the area of screening out of debris and enhancing the channeling of the water flow over the screen, as well as installation of the device.

Particularly, prior art debris preclusion devices often cannot adequately handle or allow the flow of rainwater coming off the roof of a house into the gutter. This is often due to the volume and speed of the water coming off the roof. When conventional devices cannot adequately handle the water flow, the rainwater undesirably flows over the gutter guard device and onto the ground rather than being rerouted by the gutter to a down-spout. By creating a device with a raised arc more of the rain water is channeled through the device.

Conventional debris preclusion devices are generally installed over the top of existing gutters and gutter supports, which connect and support the outside edges of the gutters to a building. Conventional debris preclusion devices, by being installed over the gutters and gutter supports, disadvantageously add to the overall weight and cost for the gutter system.

Conventional debris preclusion devices are required to be fastened to the outside gutter edge with fasteners, such as screws, adhesive or the like. This disadvantageously adds to the overall cost and weight of the gutter system.

SUMMARY OF THE INVENTION

This invention overcomes the drawbacks and shortcomings of the prior art conventional devices. These and other features and advantages of this invention are described in, or are apparent from, the following detailed description of various exemplary embodiments of the devices and methods according to this invention.

The present invention includes a gutter debris preclusion device or gutter guard with a raised arc, which enables more rain water to be channeled through the device as compared to conventional devices.

Embodiment of the present invention include a plurality of ribs, which support the screen, to define the arc profile. In some exemplary embodiments of the present invention, the ribs include sharp edges disposed adjacent to the screen. The sharp edges are angled toward the roof. The sharp edges basically slice the rainwater away or shear it from the screen and create a less obtrusive route for the water to flow than in a conventional flat rib top design.

The present invention further includes a includes a gutter lip snap-in feature, wherein the lip of the device securely engages the gutter lip eliminating the need for screwing the lip to the gutter. Further when in certain exemplary embodiments, the other end of the device, the tab is fastened to the building and the snap-in feature is included, the need for conventional gutter support brackets to hold up a gutter is eliminated as the device actually supports the gutter to the building. Traditionally, there is one gutter support bracket for every three feet of gutter for holding up the gutter to the roof. The device of the present invention acts as the support bracket for holding up the gutter. The present invention reduces the costs of the gutter system because traditional support brackets to connect the gutter to the roof are no longer needed.

The invention provides a gutter debris preclusion device for use with a gutter attached to a building, comprising a support structure being substantially rigid and having a recess with a plurality of apertures and a plurality of ribs; a screen having a plurality of apertures and being at least partially disposed on the ribs of the support structure; and, wherein a cross-sectional profile of the screen has an arc shape.

Still further, the invention provides a gutter debris preclusion device, the arc shape of the screen is centered within the recess of the support structure. And yet in other embodiments, the arc shape of the screen is off center from the center of the recess of the support structure. Other embodiments of the present invention provide for where at least one of the ribs of the device has a top portion, which includes a sharp edge disposed adjacent to the screen.

The invention provides a gutter guard wherein the recess includes a floor and two opposing side walls, each of the plurality of ribs includes a top portion having a sharp edge disposed adjacent the screen and a plurality of troughs are defined by the plurality of ribs, the floor and the two opposing side walls. Still further a gutter guard is provided wherein the recess of the support structure includes a floor, the support structure includes a lip portion operably configured to rest upon a gutter lip of the gutter and the lip includes a drip wall, wherein the drip wall extends from the floor of the support structure into a main fluid channel of the gutter when the device is in use.

The invention provides a gutter debris preclusion device wherein the support structure includes a lip portion operably configured to rest upon a gutter lip of the gutter and the lip includes an extended tip, wherein the extended tip extends past the gutter lip of the gutter when the device is in use. Still further, the invention provides a gutter debris preclusion device as recited in claim 1, wherein the building includes a roof having a roof pitch and the arc profile of the screen has an arc height, and wherein as the roof pitch increases for each application, then the arc height increases for each application.

The invention provides a gutter debris preclusion device wherein the recess includes a floor having a generally arced cross sectional profile. Other embodiments of the invention provide a gutter debris preclusion device wherein the support structure includes a tab operably configured to be attachable to a building. Still further a gutter debris preclusion device is provided wherein the tab includes a bent portion operably configured to attach to a fascia of the building and in other embodiment the device includes a fascia bracket operably configured to attach to a fascia of the building and wherein the tab includes a bent portion operably configured to engage the fascia bracket when in use.

The invention provides a gutter debris preclusion device for use with a gutter attached to a building, comprising a support structure being substantially rigid and having a recess with a plurality of apertures and a plurality of ribs; a screen having a plurality of apertures and being at least partially disposed on the ribs of the support structure; and, wherein the support structure includes a connection member operably configured to engage a gutter lip of the gutter without additional fasteners.

The invention provides a gutter debris preclusion device wherein a cross-sectional profile of the screen can either be an arc shape in one embodiment or a non-arced shape, such as planar shaped, in other embodiments.

The invention provides a gutter debris preclusion device wherein the connection portion includes a lip portion having a top portion and a connector member biasedly opposed to one another and wherein the top portion is operably configured to engage a top edge of a gutter lip of the gutter and the connector member is operably configured to engage a bottom edge of a gutter lip of the gutter when the device is in use. Still further, the connection portion includes a connecting member operably configured to engage an end of the gutter lip and a lip portion operably configured to engage a groove disposed an exterior surface of the gutter when the device is in use. Yet in other embodiments, the devices includes a clip operably configured to be disposable within the gutter lip and wherein the connection portion engages the clip when in use. Still further in other embodiments, the support structure is attached to the gutter lip and to the building.

These and other features and advantages of this invention are described in, or are apparent from, the following detailed description of various exemplary embodiments of the devices and methods according to this invention.

BRIEF DESCRIPTION OF THE DRAWINGS

Various exemplary embodiment of this invention will be described in detail, with reference to the following figures, wherein;

FIG. 1 is a perspective view of a gutter debris preclusion device installed on a gutter of a house made in accordance with the present invention;

FIG. 2 is a cross-sectional view of a channel of a prior art gutter debris preclusion device;

DETAILED DESCRIPTION OF THE PREFERRED EMBODIMENTS

Figure 3:
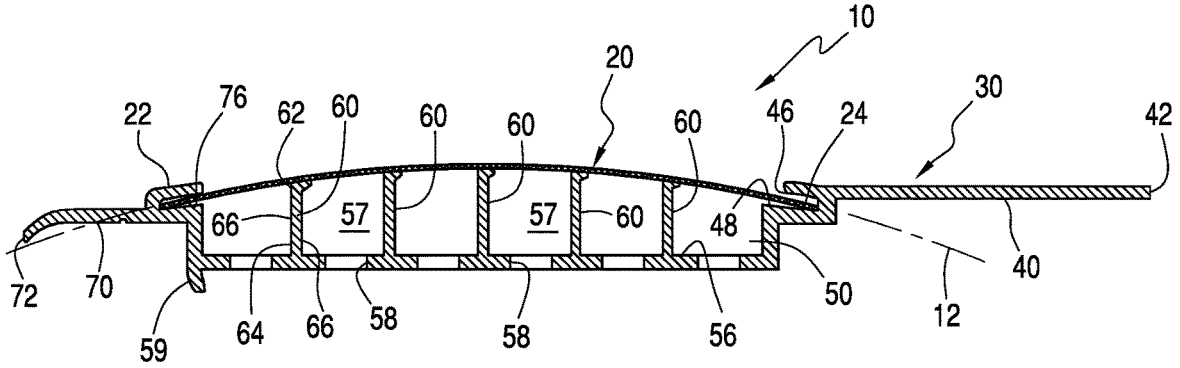
FIG. 3 is a side cross-sectional view of the gutter debris preclusion device of FIG. 1.

Referring to the drawings, wherein like reference numerals represent like parts throughout the various drawing figures, FIG. 1 displays a partial perspective view of a debris preclusion device or gutter guard 10, made in accordance with the present invention. The device 10 is shown in use on a gutter G attached to a building B.

FIG. 2 displays a cross-section portion of a prior art debris preclusion device. Particularly it displays a channel 1330 of a debris preclusion device from the '912 patent. The channel 1330 is designed to support a screen, not shown. The channel 1330 includes a tab 1340 at an upper end. The channel 1330 includes a recess 1350 having a floor 1356. The channel includes a tab slot 1346 adjacent to the tab 1340. At an opposing end to the upper end, the channel includes a lip 1370 and a lip slot 1376. The opposing ends of the screen, not shown, is operably configured to engage the slots 1346 and 1376. A series of ribs 1360 extend up from the floor 1356 to support the screen, not shown. The tops of the ribs generally lie within the same plane 1337, which is also the same plane as the bottom of the slots 1346 and 1376. This design is considered to be a flat support profile design.

FIGS. 1, and 3-6 display the debris preclusion device 10, made in accordance with the present invention. The device 10 includes a screen 20 and a screen support member or channel 30. In general, this embodiment includes features to improve the overall effectiveness of screening out debris and increasing fluid flow into the gutter. Further, the present invention, as shown in this embodiment primarily differs from the original flat support design of the channel of conventional devices and that of the '912 patent, in that the channel 30 includes an arced support profile 12 for the screen 20 as shown in FIGS. 1 and 3-6 and described below. The arced support profile 12 aligns with the profile of the screen 20.

Water traveling off of shingles S upon the roof R pass onto the screen 20 of the device 10. The channel 30 supports the screen 20 in position while also drawing the water through the screen 20 and into the recess 50 for further delivery down into the rain gutter G. Any debris falling off of the shingles S and onto the screen 20 of the device 10 either remain upon the device 10 or fall off of the screen 20 and away from the gutter G so that the gutter G can remain free of debris and functioning properly.

The screen 20 precludes debris, such as leaves, twigs and smaller or larger debris, from passing into the gutter G while allowing the water to pass into the gutter G. The channel 30 is provided to support the screen 20 in a desired position and orientation. The channel 30 also functions to draw the water through the screen 20 by capillary action so that the water desirably passes into the gutter G.

The screen 20 includes a lower edge 22 parallel with and spaced from an upper edge 24. The edges 22, 24 are spaced apart by a distance similar to a width of an opening of the gutter G. The screen 20 includes side edges 26 extending between the lower edge 22 and upper edge 24 at ends of sections of the device 10. Typically the barrier 10 is provided in separate sections for convenience in covering rain gutters G of various different lengths.

The screen 20 can be any form of fenestrated structure capable of allowing water to pass therethrough but blocking debris from passing therethrough. The screen 20 is preferably formed of a flexible material with uniformly sized fenestrations. Most particularly, this screen 20 is formed of stainless steel woven wire with the fenestrations in the screen 20 sized to provide approximately 8,000 holes per square inch. It should be appreciated that materials other than stainless steel can be utilized. With such small fenestrations, twigs, sand and leaf stems are precluded from sticking in the fenestrations, and practically all debris harmful to the proper functioning of the gutter G is precluded from passing therethrough. It should be appreciated that the wire can have as few as 196 holes and as many as 8,200 holes per square inch. In certain areas on the roof, such as the valleys where there is a great volume of rainwater flow, then fewer holes are recommended because they allow more rainwater to pass through at higher volumes. However, in other areas where rainwater does not come down in high volumes off the roof, such as on straight runs, then a higher amount of holes can be more appropriate, like the 8,000 per square inch. The advantage of having a higher amount of holes per square inch, like the 8,000, is that it can keep smaller debris out of the gutter, such as pollen, or very fine roof sand grit particles.

The channel 30 includes a tab 40 at an upper end. The tab 40, in this embodiment, preferably fits directly between the shingles S and the felt or other vapor barrier upon the roof R, so that an upper side of the channel 30 is supported in the desired position overlying the gutter G. For convenience, the roof R is considered to include all portions of the covering of a building except for the shingles S. The shingles S are considered to include the uppermost layer of material, and can be "composite" shingles, tile, wood shake, slate, stone, or any other roofing material available to provide the uppermost layer. A recess 50 defines a portion of the channel 30 adjacent the tab 40. The recess 50 includes a floor 56 defining a lowermost portion of the channel 30. A series of ribs 60 extend up from the floor 56 of the recess 50 to support the screen 20 in a desired position and an arced profile above the floor 56 of the recess 50. A lip 70 defines an edge of the channel 30 opposite the tab 40. The lip 70 is adapted to be secured to a portion of the gutter G most distant from the roof R, such as with a screw 34 or other fastener.

The channel 30 provides a rigid underlying structure for supporting the screen 20 where desired over the gutter G, and for encouraging water migration through the screen 20 by capillary action. The channel 30 also provides for mounting of the device 10 upon the gutter G and roof R. Particularly, mounting holes 32 are preferably provided along a forward edge of the channel 30. The screws 34, such as sheet metal screws, can pass through the mounting holes 32 and be threaded into a portion of the gutter G distant from the roof R. The device 10 is thus securely held in position over the gutter G.

The channel 30 is preferably shaped to have a constant cross-sectional form, as shown in FIG. 3. Preferably, the channel 30 is formed of rigid die extruded aluminum or other metals and materials.

The tab 40 secures a portion of the channel 30 opposite where the mounting holes 32 and screws 34 are utilized to fasten to the gutter G. Particularly, the tab 40 is adapted to fit between the roof R and shingles S to secure one side of the channel 30. Between the tab 40 and the screws 34, the device 10 is securely held in place over the gutter G.

The tab 40 includes a tip 42 which defines a portion of the channel 30 most distant from the mounting holes 32. The tip 42 also defines a width of the tab 40. Preferably, this tab 40 width is sufficient to cause the tab 40 to be securely held just beneath the shingles S. Typically, this distance is at least one centimeter and most preferably two to three centimeters. The tab 40 includes notches in surfaces thereof, not shown, to increase the ability of the tab 40 to be shortened, if the tab 40 is excessively wide.

The tab 40 is shown extending parallel with the floor 56 of the channel 30 generally. If a particularly steeply pitched roof is provided, it is conceivable that the tab 40 could be bent so that it is oriented in a plane distinct from other portions of the channel 30. Alternatively, the tab 40 can be shortened or entirely removed to accommodate steeply pitched roofs.

The tab 40 includes a tab slot 46 for supporting the upper edge 24 of the screen 20. The tab slot 46 is closed on three sides, with one open side in the tab slot 46. The open side of the tab slot 46 faces a lip slot 76 adapted to hold the lower edge 22 of the screen 20. An upper shelf 48 defines one side of the tab slot 46 below the tab slot 46, which extends further than other portions of the slot 46. This upper shelf 48 supports a portion of the screen 20, and discourages buckling of the screen 20 in a downward fashion when loaded with debris or otherwise encountering forces, which would tend to drive the screen 20 downward.

The recess 50 defines a portion of the channel 30 extending between the tab 40 and the lip 70. The upper plane can generally be defined as including the tab slot 46 and the lip slot 76. The recess 50 includes an upper wall 52 and a lower wall 54 on opposite sides of the recess 50.

The floor 56 extends between lower portions of the walls 52 and 54. The floor 56 includes a plurality of apertures 58 passing there through. These apertures 58 are preferably elongate with a significantly greater length than width and with a length thereof extending parallel with a long axis of the channel 30. The floor 56 is broken up into a plurality of troughs 57 between adjacent ribs 60. Each of the troughs 57 preferably include a plurality of the apertures 58 therein. Preferably, the apertures 58 are closer to a rib 60 on a lower side of each trough 57 than a rib 60 on an upper side of each trough 57. Because the entire lower plane and upper plane are tilted such that the tab 40 is elevated above the lip 70, locating of the apertures 58 closer to the ribs 60 on the lower side of the trough 57 decreases the possibility of puddling of water within the troughs 57.

The apertures 58 are sufficiently large so that no degree of surface tension in the water can tend to cause a film to span the apertures 58 which might otherwise preclude water migration through the apertures 58. Thus, once water is within the troughs 57 and adjacent the floor 56, the water quickly passes through the apertures 58 to drip off of the lower surface of the recess 50 of the channel 30.

The plurality of ribs 60 extend up from the floor 56 of the recess 50, with the ribs 60 extending from the lower plane 38 up to the upper plane 36. Each of the ribs 60 includes a free end 62 and a base end 64. The base end 64 is connected to the floor 56. Each of the ribs 60 preferably include sides 66, which are planar from the base end 64 up to the free end 62.

The free end 62 is operably configured to support the screen 20 over the recess 50 and the channel 30. Not only do the ribs 60 support the screen, but the ribs 60 also provide a wetted path between the screen 20 and the floor 56 so that capillary action can draw water from the upper surface of the screen 20, down through the fenestrations in the screen 20 to the surfaces of the ribs 60 and then on down to the floor 56 where the water can pass through the apertures 56 and fall down off of the recess 50 of the channel 30 and into the gutter G. Preferably, the ribs 60 are each of a similar width. In this exemplary embodiment, the ribs 60 extend perpendicularly from the floor 56. It should be appreciated that in other exemplary embodiments, the ribs extend in a non-perpendicular manner from the floor.

The lower wall or floor 56 of the recess 50 transitions into the lip 70 of the channel 30. The lip 70 supports the mounting holes 32 and screws 34 for securing the channel 30 to the gutter G. The lip 70 extends to a tip 72 defining a portion of the channel 30 most distant from the tab 40. The lip slot 76 is a mirror image of the tab slot 46 and is located within the upper plane 36 facing the tab slot 46. A lower shelf 78 extends between the lip slot 76 and the lower wall 54 of the recess 50. The lower shelf 78 further supports a portion of the screen 20 adjacent the lip slot 76 to discourage the screen 20 from being deflected downward into the recess 50.

The slots 46, 76 preferably have sufficient depth so that the lower edge 22 and upper edge 24 of the screen 20 can be securely held within the slots 46, 76 without requiring fastening of the screen 20 within the slots 46, 76. A sealant or other adhesive is preferably used to further secure the screen 20 within the slots 46, 76. Alternatively, the screen 20 can be fastened within the slots 46, 76 or otherwise fastened to the channel 30, such as through adhesive, fasteners, welding, brazing, pressing, or crimping the slots 46, 76 closed onto the screen 20 or other coupling techniques. It is preferred that the screen overlap each section (or length) of the device by a desired amount, such as 0.5 inch. Further, it is preferred that during manufacturing the overlapping screen will be bent down on both sides. In this manner, when a section of the device is installed next to another section of the device, the edges butt up against one another to form a smooth seam.

In use and operation the device 10 is installed upon the gutter G. Particularly, lengths of the device 10 are placed over the gutter G with the lip 70 resting upon a forward edge of the gutter G. Screws 34 or other fasteners are utilized to secure the lip 70 to the gutter G. Before the screws 34 are utilized, the tab 40 is slid between the shingles S and the roof R. If necessary, the tab 40 can be removed to accommodate a steeply pitched roof R and then transition to allow the remaining portions of the channel 30 to extend over the gutter G to the lip 70 where the lip 70 supports the screw 34 for fastening of the channel 30 to the gutter G.

At ends of the gutter G, excess portions of the barrier 10 can be cut utilizing a saw for cutting of the aluminum and scissors or other cutting tools for cutting of the material forming the screen 20. Where outside corners are encountered in the gutter G, the channel 30 can be cut at a 45-degree angle. At inside corners, most preferably the screen 20 is replaced with a screen having larger fenestrations. Most preferably, such an alternative screen would have no less than fourteen (14) fenestrations per inch in each direction (preferably 256 per square inch). In this way, the greater concentration of debris tending to gather at inside corners will not block the screen 20. Alternatively, other forms of joints can be utilized to position the device 10 where desired at inside and outside corners over corresponding bends in the gutter G.

The device 10 includes features to create a raised arc profile, as shown in FIGS. 1, and 3-6. The screen 20 is correspondingly arced to substantially match the raised arc shape of the channel 30. This arced profile is significantly different than the planar profile of conventional devices.

Figure 5:
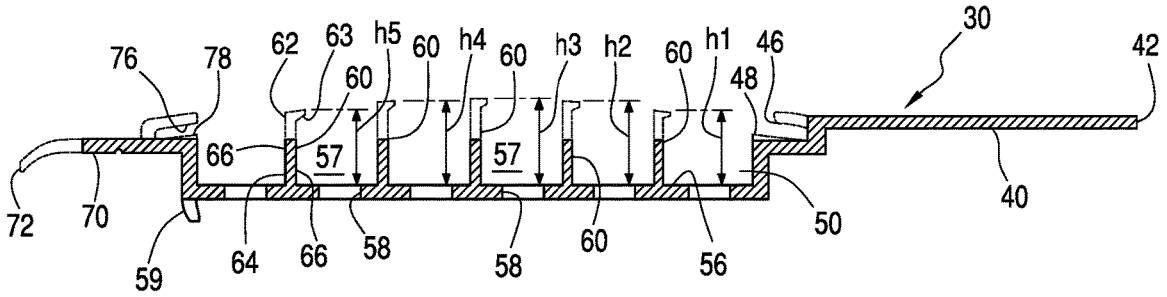
FIG. 5 is a side cross-sectional view of the gutter debris preclusion device of FIG. 1 illustrating differences with a prior art device.
Figure 6:
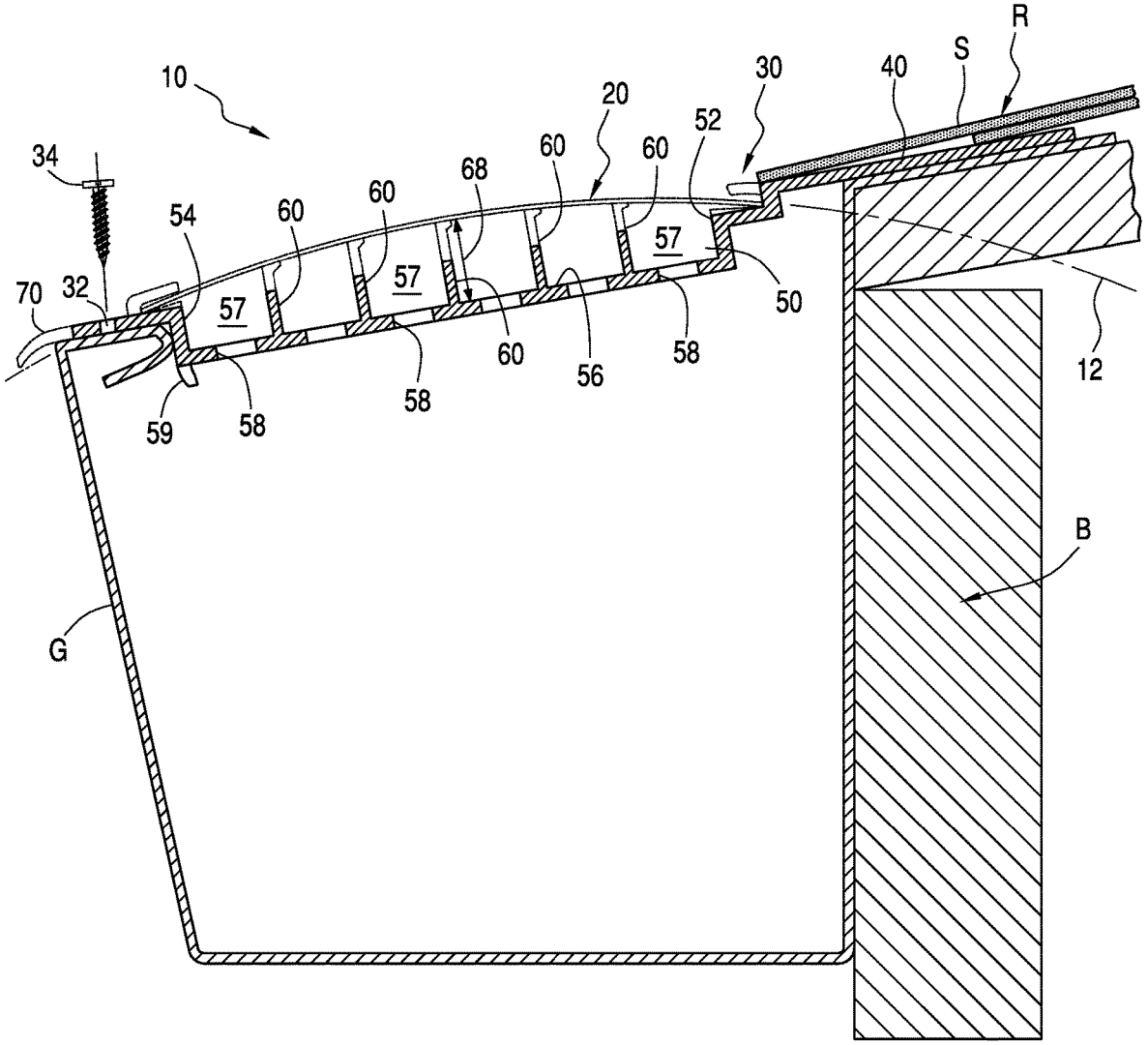
FIG. 6 is a side cross-sectional view of the gutter debris preclusion device of FIG. 1 shown in use with a building having a gutter illustrating differences with a prior art device.

FIGS. 5-6 show partial cross-sectional views. FIG. 5 shows just the channel 30 and FIG. 6 shows just device 10 with the channel 30 and the screen 20 in use on a gutter G disposed on a building B. For clarity of illustrating the differences between the flat profile design of the '912 patent and the device 10 of the present embodiment, the portions of: the ribs 60; the slots 46 and 76; the tip 72 of the lip 70; and, the floor 56, are shown without cross-hatching. These non cross-hatched areas identify the channel structural differences between an embodiment of the present invention and the flat profile design.

Figure 4:
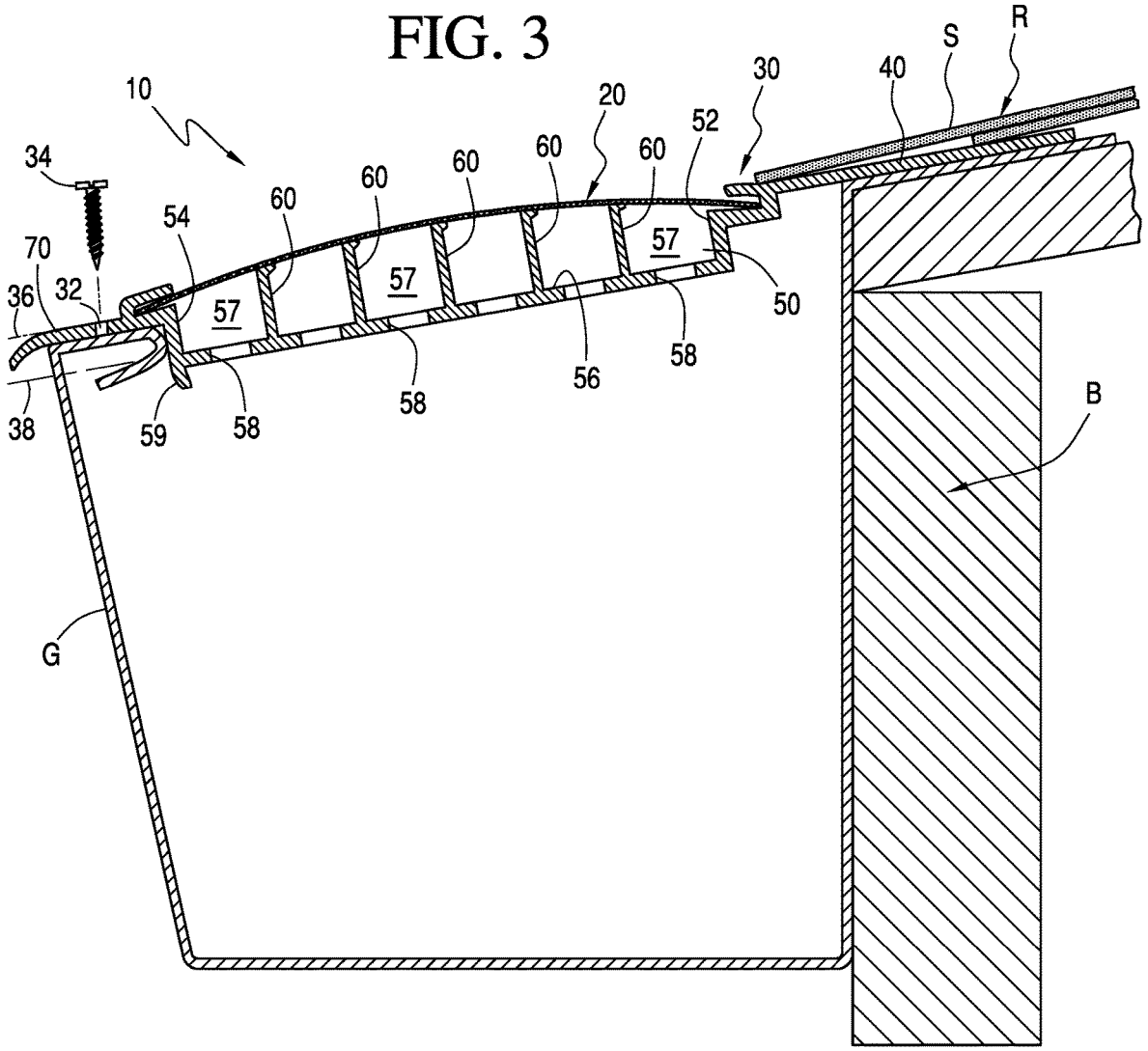
FIG. 4 is a side cross-sectional view of the gutter debris preclusion device of FIG. 1 shown in use with a building having a gutter.

The ribs 60 of the present invention are shaped, relative to one another, so as to form a generally arc shape from the side view as shown in FIG. 5. The arc shape create a raised arc profile 12 for the screen 20 to rest upon as shown in FIG. 6. Further, the slots 46 and 76 are also preferably slightly angled to engage the screen, as shown in FIGS. 3-4 and 6. Each of the ribs 60 (or walls) has a height relative to the floor of the channel, namely the dimensions h1, h2, h3, h4 and h5. The height of the ribs increases relative to each other from the outsides of the channel to the center, so as to create an arc profile shape for the screen to rest upon. The dimension h3 is greater than h2, and h2 is greater than h1. In this embodiment h2 equals h4 and h1 equals h5. The arc profile shape has a max height 68, which is the dimension h3. It is preferred that the max height 68 be located at a rib disposed in the center of the recess 50. It should be appreciated however that the max height, could in other exemplary embodiments be located at a different rib. It should be appreciated that in other exemplary embodiments h2 does not have to equal h4. It should be appreciated that in other exemplary embodiments h1 does not have to equal h5. It should be appreciated that in other exemplary embodiments h3 does not have to be the largest dimension for the rib heights.

Further, it is preferred that at least one of the ribs includes an angled top portion. The top portion 62 of the rib 60 includes a sharp edge 63. The sharp edge 63 is angled toward the roof. When rainwater flows down the roof and passes through the screen, the rain water adheres to the screen and does not immediately fall down into the gutter. The rainwater droplets touch the acute angle of the sharp edge 63 of the top portion 62 of the rib 60 and the rainwater falls down the channel wall more efficiently, faster and with less hindrance as opposed to a flat wall. The ribs 60 included with an angled top portion basically slice the rainwater away or shear it from the mesh and create a less obtrusive route for the water to flow than in a conventional flat rib top design. When the rainwater siphons underneath the mesh, it doesn't just drop in the gutter, it clings to the underside of the mesh, and travels towards the first rib. The sharp edge 63 helps scrape this rainwater from the underside of the mesh, and more efficiently pulls the rainwater down through the fenestrations in the screen 20 to the surfaces of the ribs 60 and then on down to the floor 56 where the water can pass through the apertures 56 and fall down off of the recess 50 of the channel 30 and into the gutter G. This is in stark contrast to conventional devices that have ribs with squared-off top portions.

Further it is preferred that the channel 30 include at least five ribs 60 that include the sharp edges 63. Having the successive ribs with the sharp edges will act upon the water flowing over the device from the roof in manner like successive blades, with each blade in series shearing more and more of the water from the flow. The successive sharp edges of the present invention is especially helpful in situations with high volumes of water coming off the roof.

The ribs 60 are preferably each of a similar width. In this exemplary embodiment, the ribs 60 extend perpendicularly from the floor 56. It should be appreciated that in other exemplary embodiments, the ribs extend in a non-perpendicular manner from the floor. For each trough 57 defined by ribs 60 having the sharp edges 63, the amount of rainfall that can be drawn into the gutter increases significantly.

For purposes of illustration some rainwater drainage rate comparisons between the ribs with sharp edges made in accordance with the present invention and conventional devices having ribs with either rounded or squared off top portions. Some of the dimensional properties used for the comparisons are as follow: apertures in bottom of recess is 0.75 square inches in the shape of an oblong hole with rounded or square edges on the ends, with the in-between widths of the oblong holes being either narrowed in the middle, or increase in girth), spaced a minimum distance of 1 inch, not more than 1.5 inches apart on the bottom of the troughs; and in addition to this, the trough size has a minimum width distance of 0.375 inches. With these dimensional proportions, but in combination with the sharp edges as described above, the following results are observed for an exemplary embodiment of the present invention:

Device with one (1) trough can draw down up to 20 inches of hourly rainfall;

Device with two (2) troughs can draw down up to 40 inches of hourly rainfall;

Device with three (3) troughs can draw down up to 60 inches of hourly rainfall;

Device with four (4) troughs can draw down up to 80 inches of hourly rainfall;

Device with five (5) troughs can draw down up to 100 inches of hourly rainfall; and, Device with six (6) troughs can draw down up to 120 inches of hourly rainfall.

For a conventional device with the same dimensional proportions, but with conventional squared off top for the ribs, the following results are observed:

Conventional device with one (1) trough can draw down up to 17 inches of hourly rainfall;

Conventional device with two (2) troughs can draw down up to 34 inches of hourly rainfall;

Conventional device with three (3) troughs can draw down up to 51 inches of hourly rainfall;

Conventional device with four (4) troughs can draw down up to 68 inches of hourly rainfall;

Conventional device with five (5) troughs can draw down up to 85 inches of hourly rainfall; and, Conventional device with six (6) troughs can draw down up to 102 inches of hourly rainfall.

For a comparison with another conventional device having the same dimensional proportions, but with conventional rounded off top portions for the ribs, the following results are observed:

Conventional device with one (1) trough can draw down up to 15 inches of hourly rainfall;

Conventional device with two (2) troughs can draw down up to 30 inches of hourly rainfall;

Conventional device with three (3) troughs can draw down up to 45 inches of hourly rainfall;

Conventional device with four (4) troughs can draw down up to 60 inches of hourly rainfall;

Conventional device with five (5) troughs can draw down up to 75 inches of hourly rainfall; and, Conventional device with six (6) troughs can draw down up to 90 inches of hourly rainfall.

These practical results comparing conventional designs to the top portions of the ribs of the present invention reveal the advantages of the sharp edges of the present invention.

The tip 72 of the lip 70 extends further over and past the front edge of the gutter G. The tip 72 also includes a profile that is angled down toward the ground relative to the gutter G. This over extension and angle further enhances the debris preclusion and allows any excess water to flow off the device. Further, the extended tip helps prevent icicles from forming at the bottom of the gutter during freezing temperatures. Even further, the extended tip can provide a location to attach decorations and holiday lights. It should be appreciated that in other exemplary embodiments, the tip does not extend past the gutter.

The floor 56 includes a drip wall 59. The drip wall 59 is disposed on the bottom side of the channel 30. The drip wall 59 extends from the bottom of the floor 56 into the gutter G. The drip wall 59 is disposed adjacent to the lip 70. In this configuration the drip wall 59 assists with directing water into the gutter. It should be appreciated that the drip wall in other embodiments can have different lengths than in the present embodiment. It should also be appreciated that the drip wall in other exemplary embodiments is disposed at other locations under the lip. It should also be appreciated that in other exemplary embodiments of the present invention the drip wall is optional.

Figure 7:
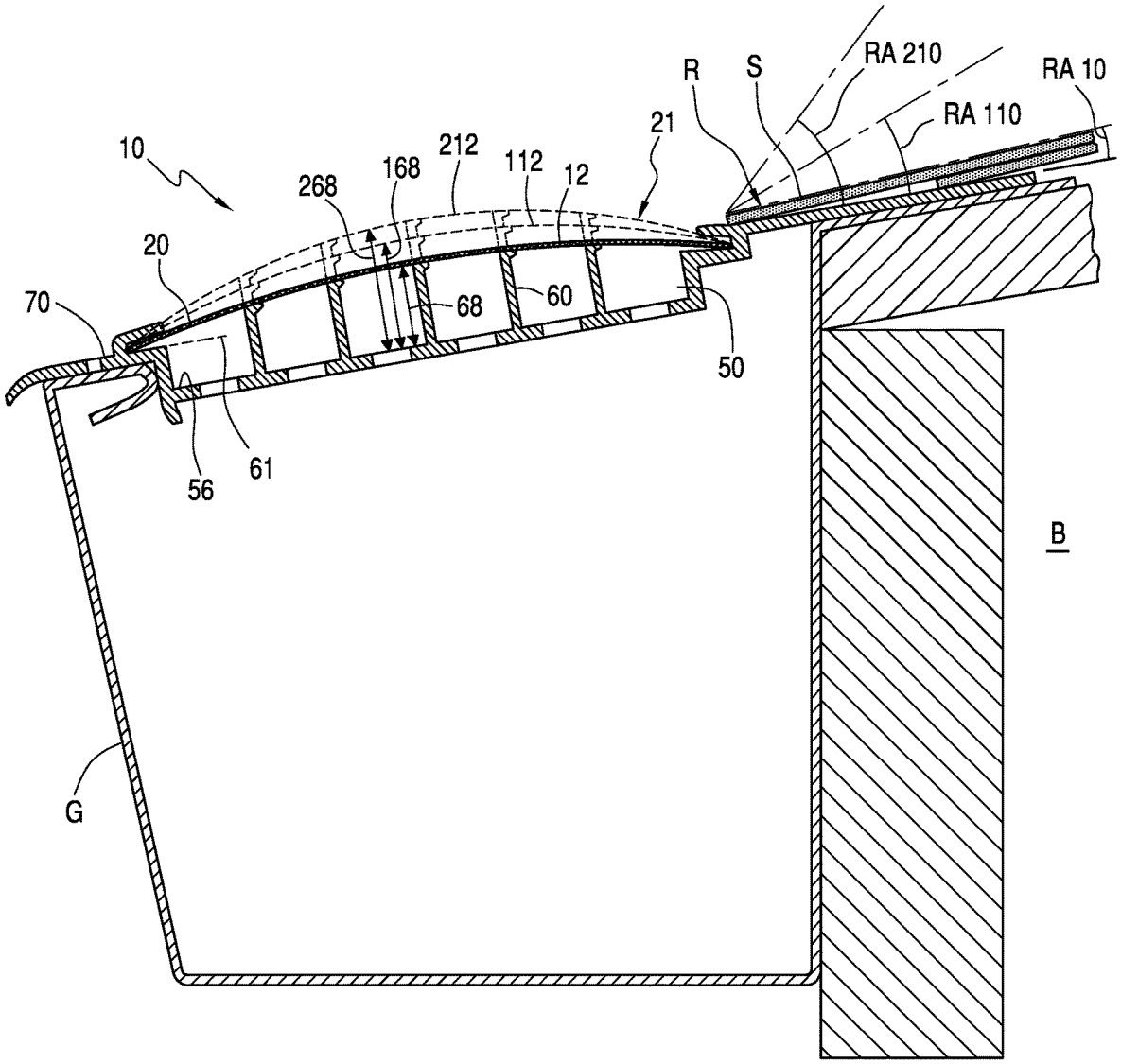
FIG. 7 is a side cross-sectional view of the gutter debris preclusion device of FIG. 1 shown in use with a building having a gutter illustrating arc profiles relative to roof angles.

It should be appreciated that the ribs 60 of the channel 30 in the device 10 can be manufactured to different dimensions. The ribs 60 can be manufactured to provide a desired arc profile. When manufacturing the channel, it should be appreciated that different shaped arcs are desired for differing applications, namely for roofs having different pitches. FIG. 7 illustrates a preferred height of an arc profile to roof angle or roof pitch ratios. In general, it is preferred that the height of the arc increases as the pitch of the roof increases.

FIG. 7 illustrates exemplary arc profiles 12, 112 and 212. These arc profiles are super-imposed to show how one can manufacture device 10 and the ribs 60 thereof to create varying arc profiles. The roof R includes a roof angle RA 10. The arc height and the corresponding arc profile are based on a series of ratios that are determined by the roof angle. The arc profile is to assist in slowing down the rainwater when it slides down the roof and hits the area 21 of the screen 20 closest to the roof R. As the height of the arc is increased the greater the impact on the slowing down of the rainwater coming off the roof. When the rainwater is slowed down, there is less of a chance of rainwater traveling off the edge of the device 10 due to excessive speed of the rainwater. The speed of the rainwater coming off the roof is dictated by the amount of rainfall occurring, but also upon the roof angle RA10. As the roof angle (or pitch) RA 10 increases to RA 110 and RA210, the velocity of the rainwater coming off the roof increases. The steeper the roof, then the faster the water will come off the roof.

When the roof R has a low pitched angle, such as RA 10, an arc height of 68 with an arc profile of 12 is preferred. When the roof R has a medium pitched angle, such as RA 110, an arc height of 168 with an arc profile of 112 is preferred. When the roof R has a steep angle, such as RA 210, an arc height of 268 with an arc profile of 212 is preferred. A low pitched roof angle, such as RA 10 is preferably about a 3/12 roof pitch, wherein the roof rises 3 inches for every 12 inches of horizontal length. With a low pitched roof angle, the arc height 68 is preferred to be 2 times the dimension 61. The dimension 61 is the height or depth of the recess 50 from the lip 70 to the floor 56. The dimension 61 can also be considered to be the height of the ribs if the arc profile was a flat profile as in conventional devices such as in the '912 patent. A medium pitched roof angle, such as RA 110 is preferably about a 6/12 roof pitch. With a medium pitched roof angle, the arc height 168 is preferred to be 2.5 times the dimension 61. A steeped pitched roof angle, such as RA 210 is preferably about a 12/12 roof pitch. With a steep pitched roof angle, the arc height 268 is preferred to be 2.75 times the dimension 61.

Figure 8:
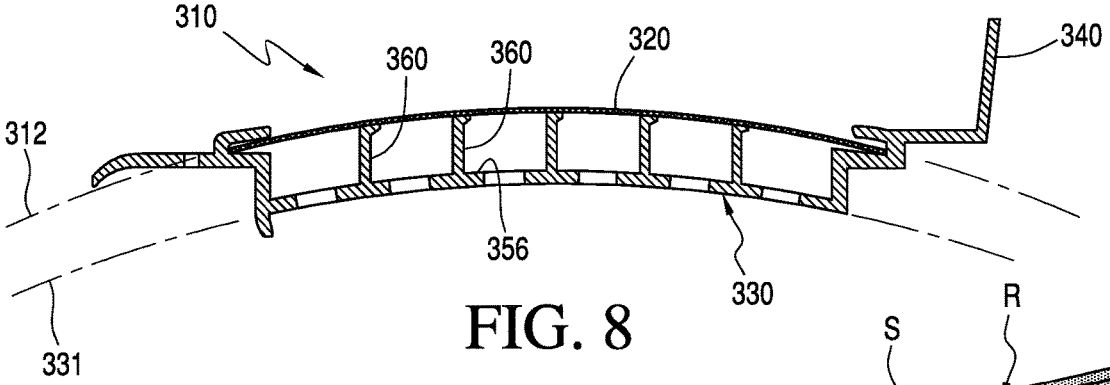
FIG. 8 is a side cross-sectional view of an alternative embodiment of a gutter debris preclusion device made in accordance with the present invention.
Figure 9:
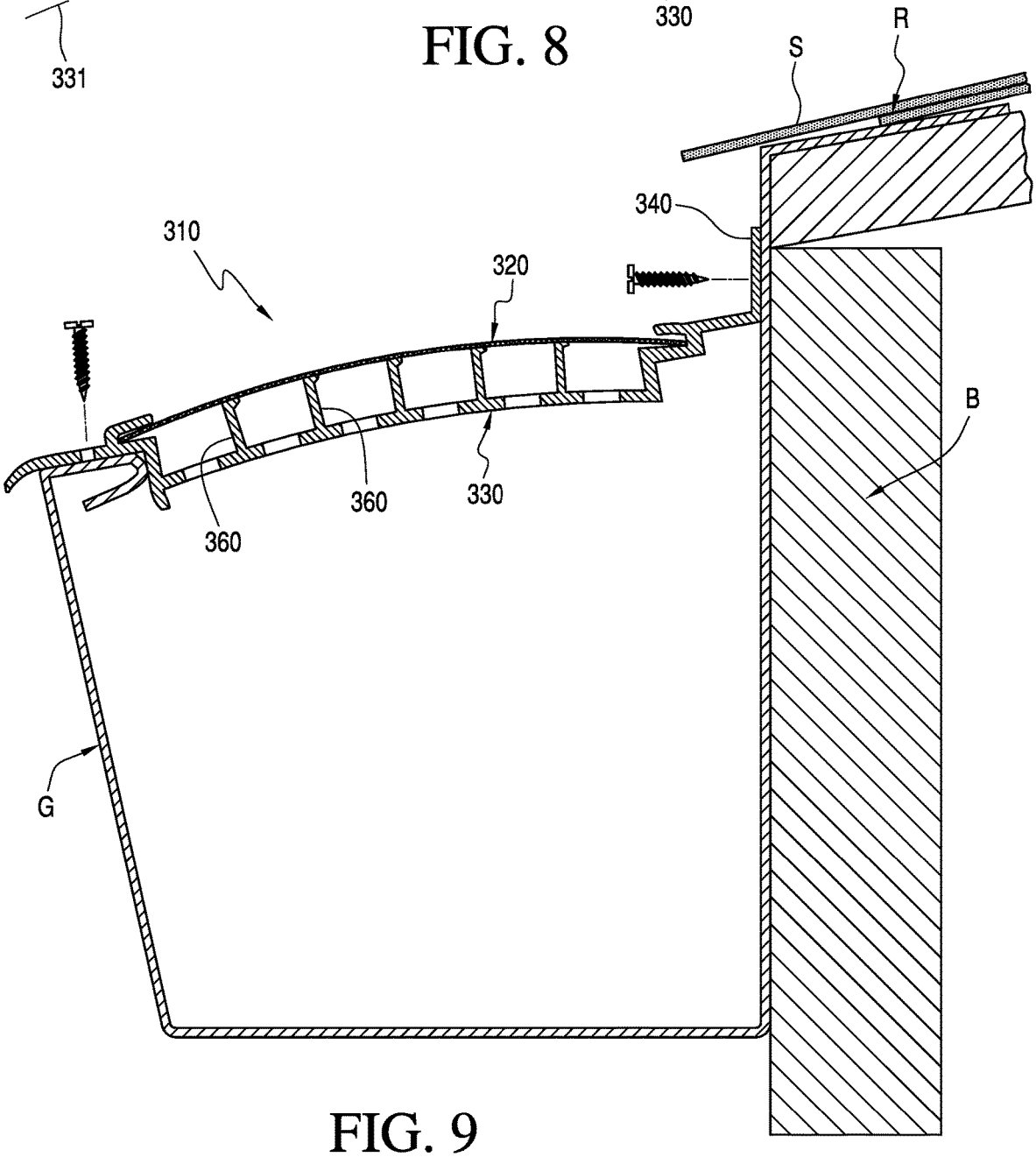
FIG. 9 is a side cross-sectional view of the gutter debris preclusion device of FIG. 8 shown in use with a building having a gutter.

FIGS. 8-9 display a debris preclusion device 310, which is an alternative exemplary embodiment of the present invention. The device 310 includes a screen 320 and a screen support member or channel 330 and is in general identical to the device 10 described above with regards to all of the features except as noted and shown. A difference between this device 310 and the device 10 is that this device is operably configured to be for an upward fascia mount installation. The channel 330 includes a tab 340 and the tab 340 bends up toward the roof shingle. This allows the gutter guard to be screwed to the back of the fascia F or the roof deck. Another difference between the device 310 and the device 10 is that the channel 330 includes a floor 356 that has a generally arced shaped profile 331, rather than flat as the floor 56 of the channel 30. The arced profile 331 matches, in shape (i.e. radius) an arc profile 312 created by a plurality of ribs 360 for the screen 320 to rest upon. The arc shaped bottom increases the overall strength and stability of the device 310.

Figure 10:
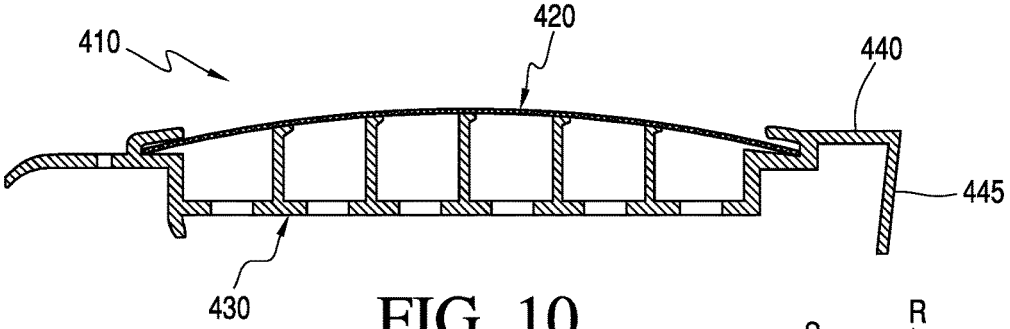
FIG. 10 is a side cross-sectional view of yet another alternative embodiment of a gutter debris preclusion device made in accordance with the present invention.
Figure 11:
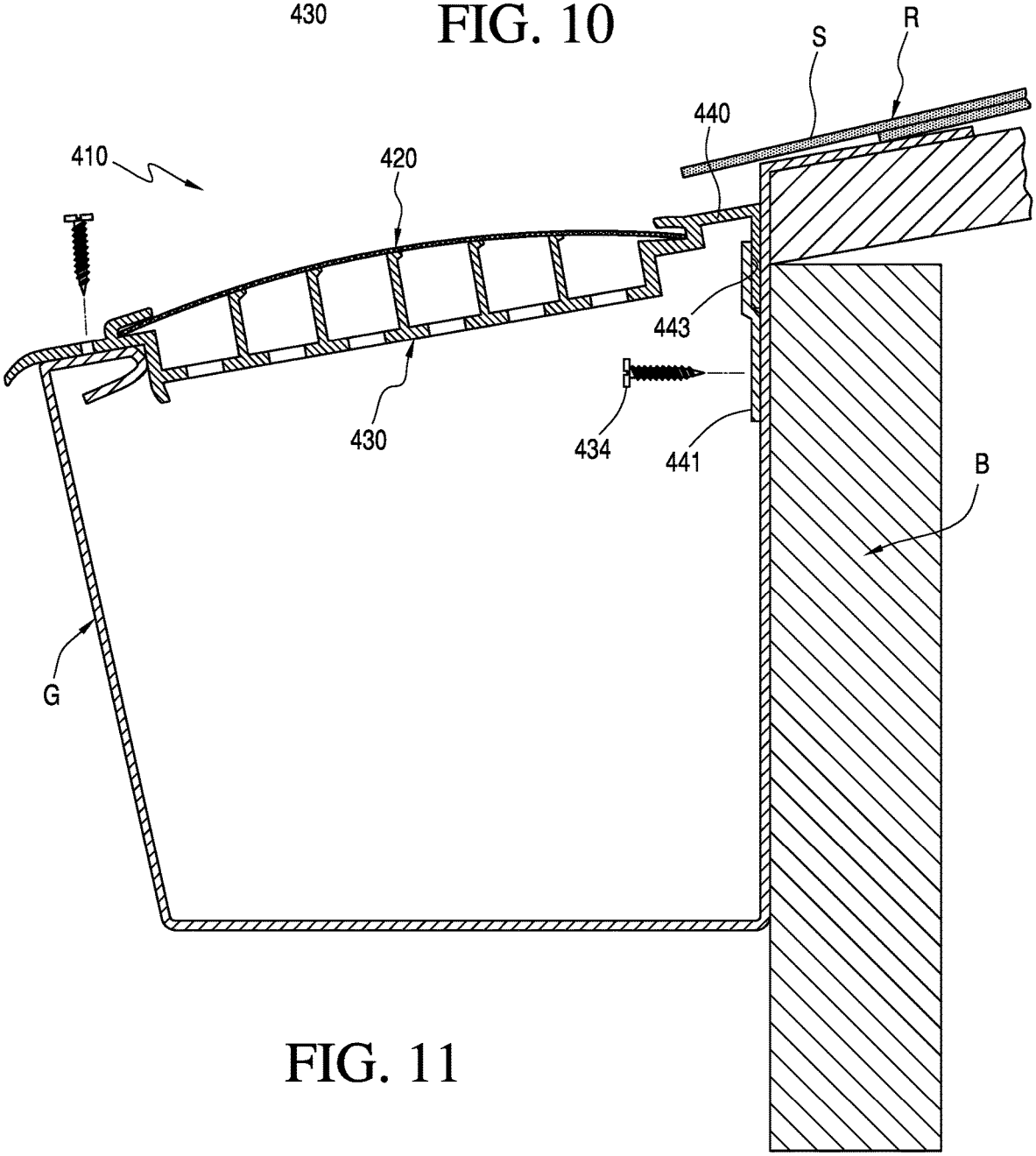
FIG. 11 is a side cross-sectional view of the gutter debris preclusion device of FIG. 10 shown in use with a building having a gutter.

FIGS. 10-11 display a debris preclusion device 410, which is an alternative exemplary embodiment of the present invention. The device 410 is identical to the device 10 described above except as noted and shown. The device 410 includes a screen 420 and channel 430 along with all of the other features of device 10. A difference between the device 10 and the device 410 is that the device 410 is operably configured to be for a downward fascia mount installation. The channel 430 includes a tab 440. The tab 440 has a portion 445 that is bent downward such that is at least perpendicular to the plane of the rest of the tab 440. The device 410 further includes amounting bracket 441, which is fastened to the back of the gutter with screws 434. The profile of the bracket 441 forms the shape of a z such that a receiving pocket 443 is formed between the bracket 441 and the back of the gutter. The portion 445 of the tab 440 is operably configured to engage the receiving pocket 443 when in use. In this manner, the device 410 is supported by the bracket 441. The fascia mount bracket 441 is installed prior to the installation of the debris preclusion or gutter guard device 410.

Figure 12:
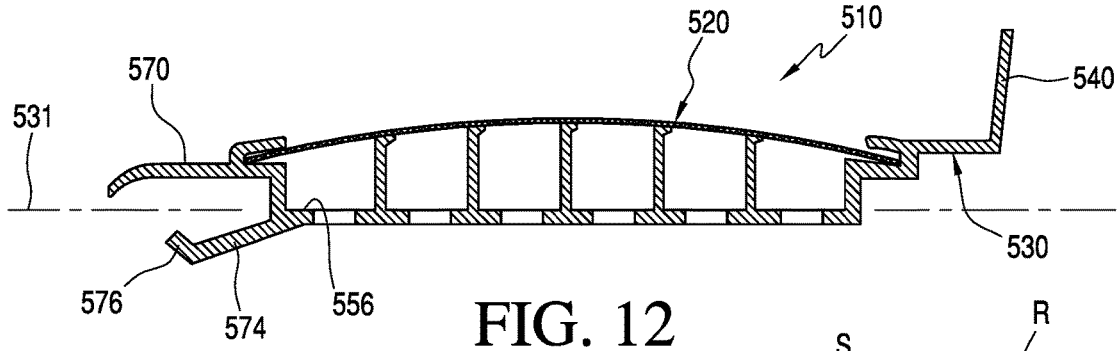
FIG. 12 is a side cross-sectional view of another alternative embodiment of a gutter debris preclusion device made in accordance with the present invention.
Figure 13:
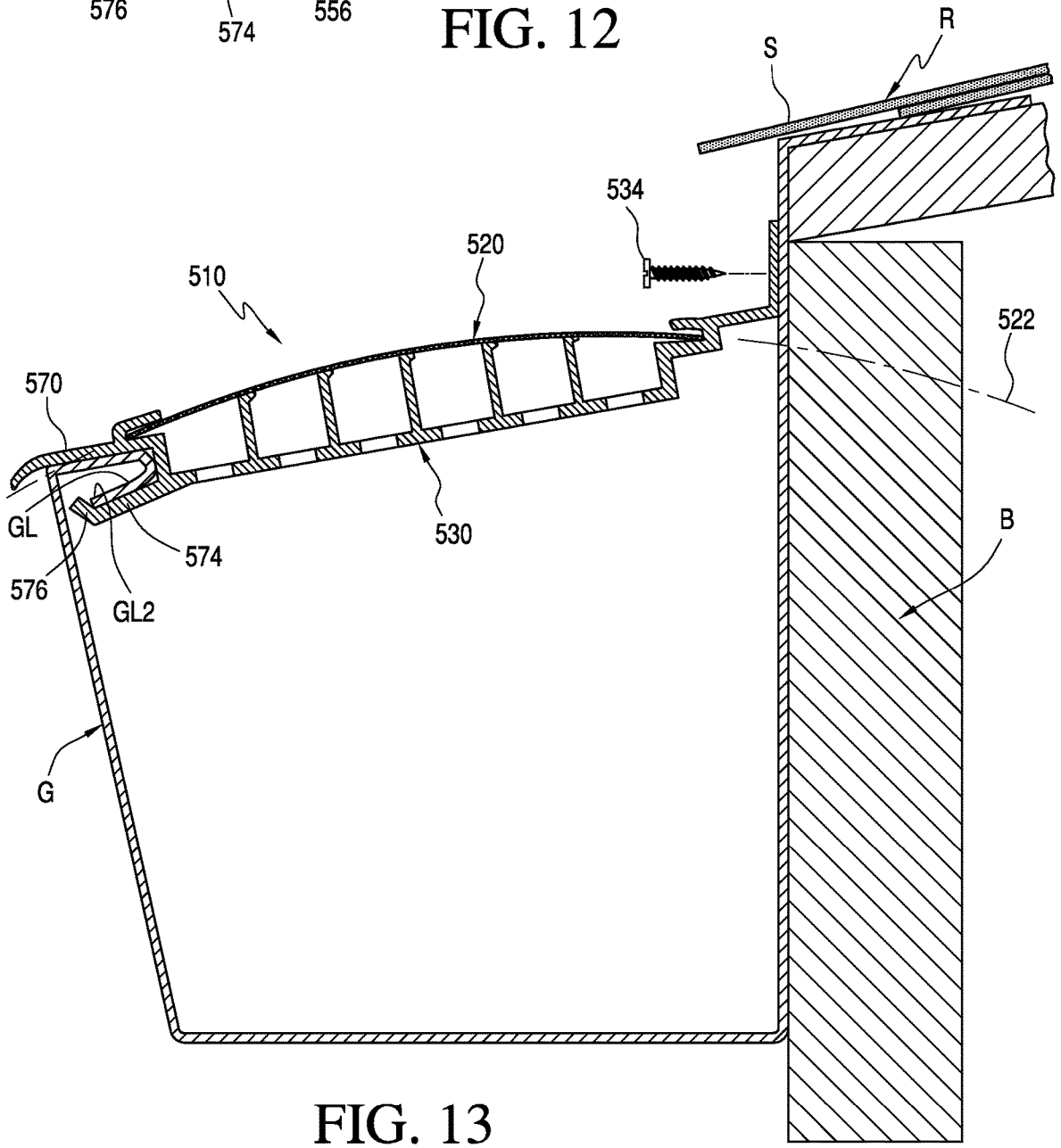
FIG. 13 is a side cross-sectional view of the gutter debris preclusion device of FIG. 12 shown in use with a building having a gutter.
Figure 14:
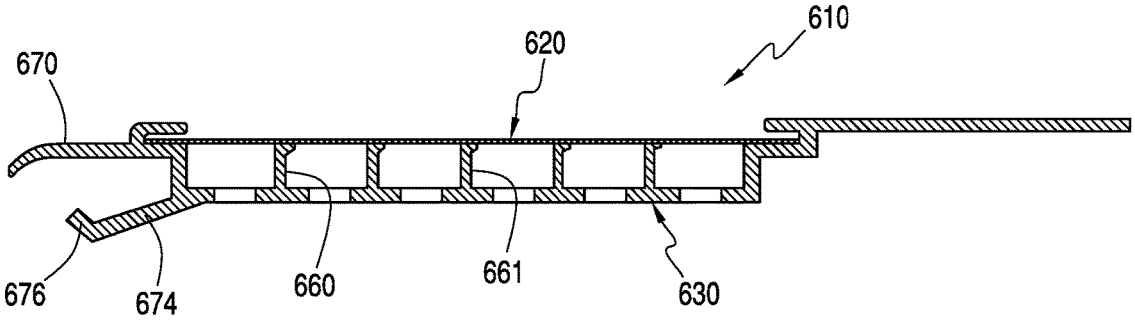
FIG. 14 is a side cross-sectional view of yet another alternative embodiment of a gutter debris preclusion device made in accordance with the present invention.
Figure 15:
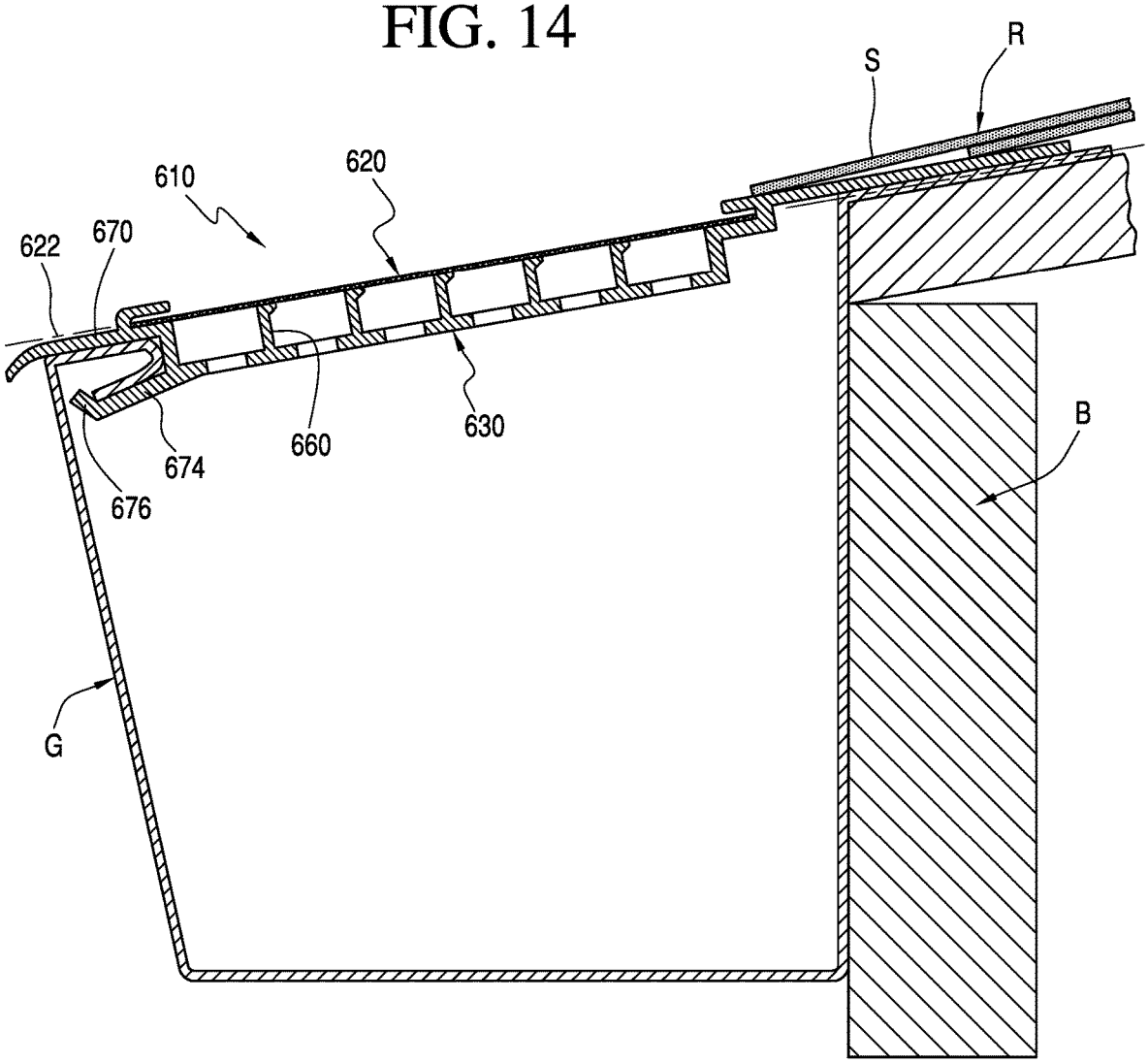
FIG. 15 is a side cross-sectional view of the gutter debris preclusion device of FIG. 14 shown in use with a building having a gutter.

FIGS. 12-19 display various alternate embodiments of the lip member of the screen support member of debris preclusion devices made in accordance with the present invention. In these embodiments, the lip includes a snap-in feature, wherein the lip securely engages the gutter eliminating the need for conventional gutter support brackets to hold up a gutter. The snap-in feature also eliminates the need for screwing the lip to the gutter. Traditionally, there is one gutter support bracket for every three feet of gutter for holding up the gutter to the roof. The device of the present invention acts as the support bracket for holding up the gutter. The lips of the channels of the devices of these exemplary embodiments include a connector member that connects to the gutter. This connector member includes a bottom-flange that in connection with the lip of the channel engage a gutter lip GL or in some embodiments a clip attached to the gutter lip GL. Debris preclusion devices with a connecting member as made in accordance with the present invention reduce the costs of the gutter system because traditional support brackets that connect the gutter to the roof are no longer needed. The debris preclusion device will be fastened directly to the gutter via the connector member. It should be appreciated that this snap-in feature can also be utilized with a conventional flat profile design for the channel as described in the '912 patent and the like, as shown in FIGS. 14 and 15.

FIGS. 12 and 13 display a debris preclusion device 510, which is an alternative exemplary embodiment or the present invention. The device 510 is identical to the device 310 described above except as noted and shown. The device 510 includes a screen 520, a screen support member or channel 530 and an arc profile 522. The channel 530 includes a tab 540 operably configured for an upward fascia mount installation. A difference between this device 510 and the device 10 is that the lip 570 in this embodiment includes a connector member or bottom flange 574. The connecting member 574 is disposed adjacent to a floor 556 of the channel 530. The connection member primarily extends away from the floor 556 and the rest of the lip 570 and into the gutter G. It is preferred that the connecting member be integral with the floor 556. The connecting member 574 is operably configured to be disposed adjacent to a gutter lip GL of the gutter G when in use. The gutter lip GL includes a gutter lip end portion GL2. The connecting member 574 includes an end portion 576. The end portion 576 is aligned in a different linear direction than the other portion of connecting member 574. Particularly, the end portion 576 extends in a direction toward the top of the lip 570. The end portion 576 is operably configured to be disposed about the gutter lip end portion GL2 when in use. The end portion 576 is the portion of the connecting member 574 that is bent in so as to be able to engage the gutter lip end portion GL2 when in use. This arrangement creates a snap-in connection engagement between the device 510 and the gutter lip GL, with the lip 570 engaging a top portion of the gutter lip GL and the connecting member 574 engaging a bottom portion of the gutter lip GL. It will be appreciated that the structural arrangements of the lip 570 and connecting member 574 may change in shape depending upon the gutter lip GL being utilized with the lip 570 engaging the top of the gutter lip GL and the connecting member 574 engaging a bottom portion of the gutter lip GL. Another difference between the device 510 and the device 310 is that the floor 556 has a flat or planar profile 531 like the floor 56 of the device 10 as opposed to an arc profile floor as in the device 310.

FIGS. 14 and 15 display a debris preclusion device 610, which is an alternative exemplary embodiment of the present invention. The device 610 is identical to the device 510 described above except as noted and shown. The device 610 includes a screen 620 and a screen support member or channel 630. A difference between this device 610 and the device 510 is that the connecting member 674, which is identical to the connecting member 574, is used on a channel 630 that has ribs 660 that create a flat screen support profile 622 as opposed to an arced profile like profile 522. It should be appreciated that since device 610 does not screw into building, it cannot be used to replace gutter support members for attaching the gutters to the building.

Figure 16:
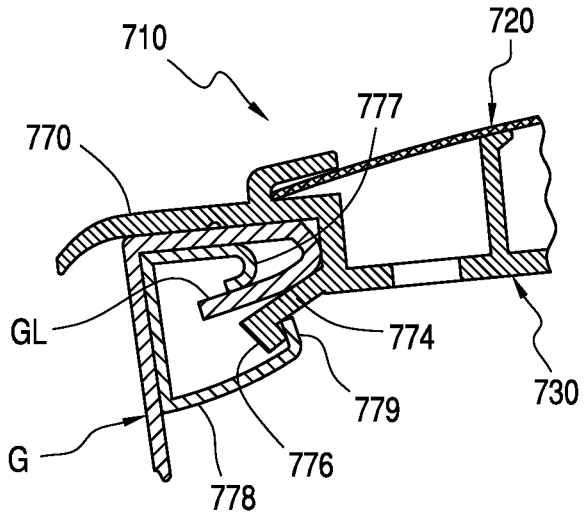
FIG. 16 is a partial side cross-sectional view of another alternative embodiment of a gutter debris preclusion device made in accordance with the present invention.

FIG. 16 displays a portion of a debris preclusion device 710, which is an alternative exemplary embodiment of the present invention. The device 710 is identical to the device 510 described above except as noted and shown. The device 710 includes a screen 720 and a screen support member or channel 730. A difference between this device 710 and the device 510 is that the device 710 includes a connecting member 774 that is operable configured to engage a clip 778. The clip 778 preferably has a generally u-shaped profile with a top portion 777 at one end of the u shape and a bottom portion 779 at the other end of the u shape. The clip 778 is snapped into the gutter lip GL of the gutter G. The top portion 777 of the clip is operably configured to be disposed in the gutter lip GL to secure the clip to the gutter G. The connecting member 774 includes an end portion 776 that is operably configured to engage the bottom portion 779 when in use. The clip is preferably made of galvanized spring steel and is made up in sections. The clips are preferably sections preferably 1 foot long and disposed about every 5 feet within the gutter lip. It should be appreciated that other shapes other than a u shape can be utilized in other exemplary embodiments for the shape of the clip. It should be appreciated that in other exemplary embodiments made in accordance with the present invention, clips can be manufactured to accommodate different types of gutter lips. Further, the clips can range in lengths as short as one inch, or they can be much longer such as 20-foot sections.

Figure 17:
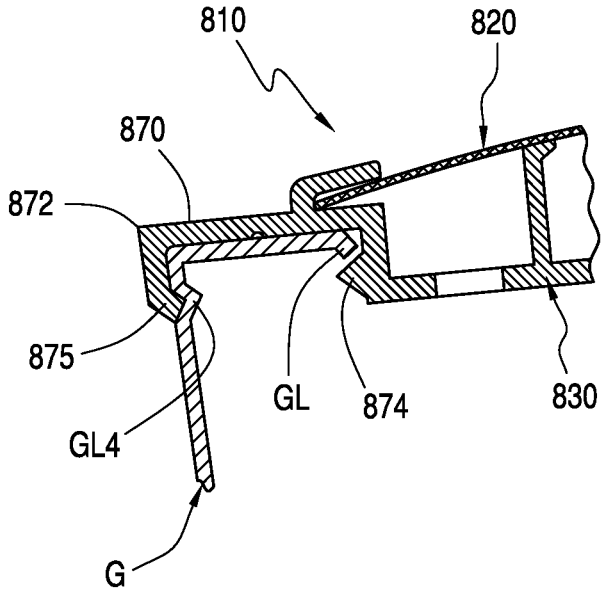
FIG. 17 is a partial side cross-sectional view of another alternative embodiment of a gutter debris preclusion device made in accordance with the present invention.

FIG. 17 displays a portion of a debris preclusion device 810, which is an alternative exemplary embodiment of the present invention. The device 810 is identical to the device 510 described above except as noted and shown. The device 810 includes a screen 820 and a screen support member or channel 830. The difference between this device 810 and the device 510 is that the snap-in feature is achieved by having a special roll formed gutter lip GL that includes a groove GL4. The lip 870 includes a connecting member 874. Connecting member 874 engages an end of the gutter lip when in use. The lip 870 further includes a leg 875 disposed at the tip 872 of the lip 870. The leg 875 extends down from the top of the lip 870. The leg 875 is operably configured to engage in the groove GL4 when in use.

Figure 18:
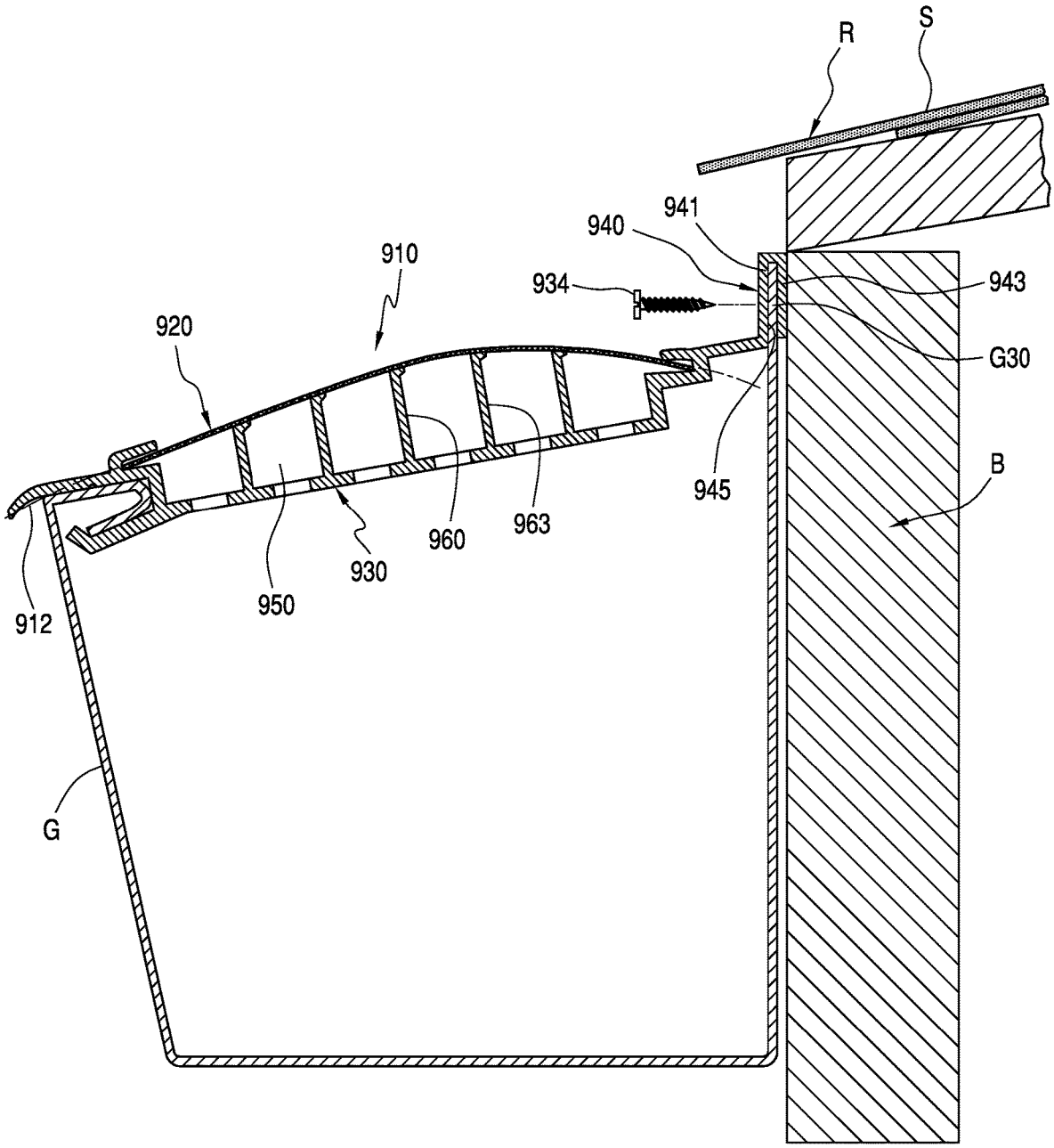
FIG. 18 is a side cross-sectional view of yet another alternative embodiment of a gutter debris preclusion device made in accordance with the present invention; and, FIG. 19 is a side cross-sectional view of yet another alternative embodiment of a gutter debris preclusion device made in accordance with the present invention.

FIG. 18 displays a portion of a debris preclusion device 910, which is an alternative exemplary embodiment of the present invention. The device 910 is identical to the device 510 described above except as noted and shown. The device 910 includes a screen 920 and a screen support member or channel 930 having a tab 940. A difference between the device 910 and the device 510 is that the device 910 is configured such that conventional gutter support members that are traditionally installed in a spaced apart relationship to hold up the gutter to the building B are not required. Particularly, the tab 940 includes upward and downward wall portions 941 and 943. Defined between the upward and downward wall portions is a slot 945. The gutter G includes an upper back edge G30. The slot is operably configured to rest upon the upper back edge G30 of the gutter G, when in use. Fasteners 934 are inserted through the wall portion 941, the gutter edge G30 and the wall portion 943 and into the building H. Only one fastener is shown for illustration purposes. It should be appreciated that along the length of the device additional fasteners, such as screws, will be utilized when the device is in use.

Another difference between the device 910 and the device 510 is that the arc profile 912 is not centered about a recess 950 of the channel 930. The max height of the arc profile 912 is off center from the center of the recess 950 as shown in FIG. 18. The max height of the arc profile 912 corresponds with the rib 963 rather than the center rib 960. The bump (max height of the arc profile) created by the ribs is not in the center of the recess 950. Rather the bump is disposed closer to the tab 940 side of the channel 930.

Figure 19:
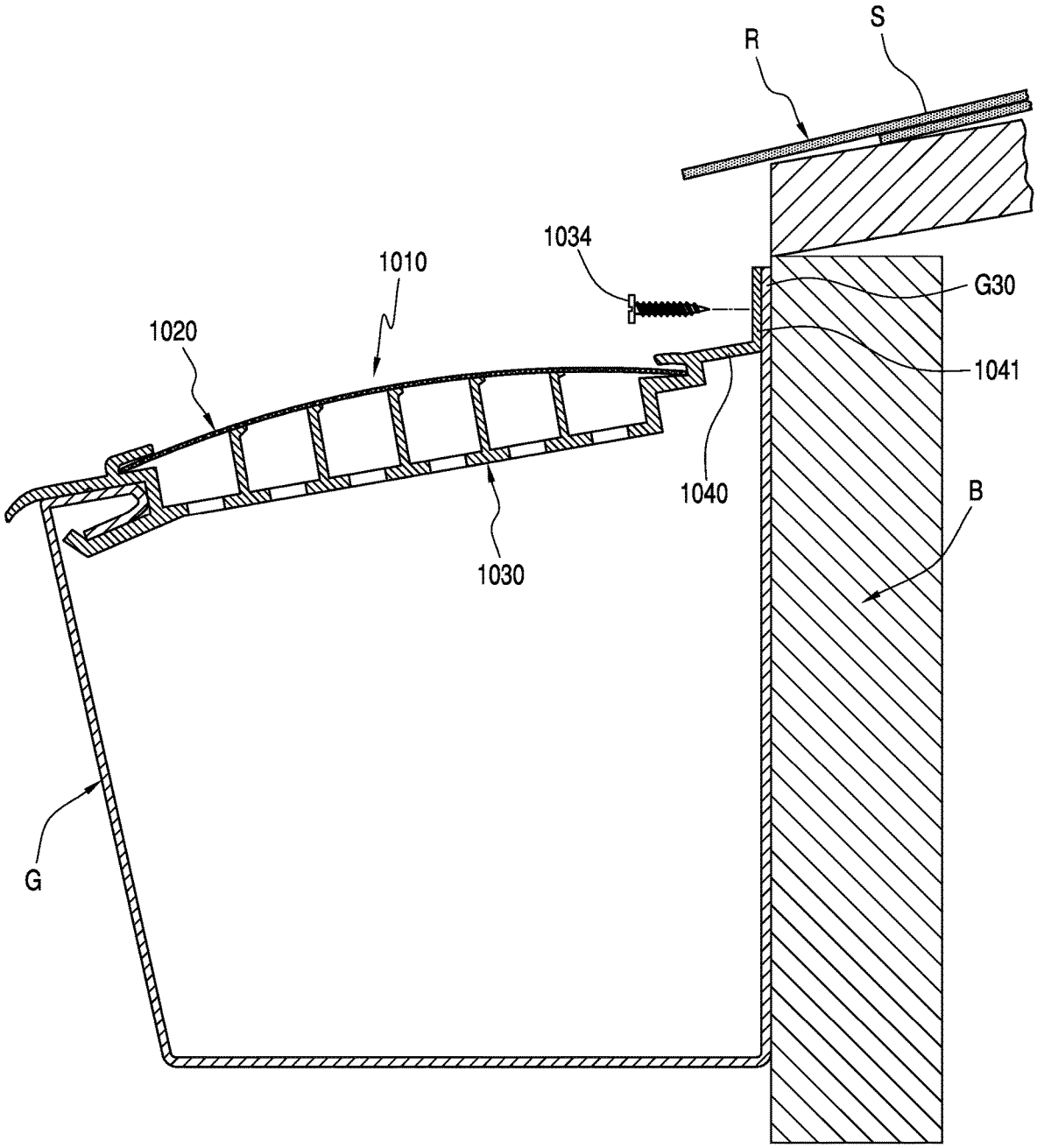

FIG. 19 displays a portion of a debris preclusion device 1010, which is an alternative exemplary embodiment of the present invention. The device 1010 is identical to the device 510 described above except as noted and shown. The device 1010 includes a screen 1020 and a screen support member or channel 1030. A difference between the device 1010 and the device 510 is that the device 910 is configured such that conventional gutter support members that are traditionally installed in a spaced apart relationship to hold up the gutter to the building B are not required. Particularly, the tab 1040 includes upward portion 1041. The gutter G includes an upper back edge G30. Fasteners 1034 are inserted through the portion 1041, the gutter edge 630 and into the building B. Only one fastener is shown for illustration purposes. It should be appreciated that along the length of the device additional fasteners, such as screws, will be utilized when the device is in use.

While this invention has been described in conjunction with the specific embodiments outlined above, it is evident that many alternatives, modifications and variations will be apparent to those skilled in the an. Accordingly, the preferred embodiments of the invention, as set forth above, are intended to be illustrative, not limiting. Various changes and combinations thereof may be made without departing from the spirit and scope of this invention. It should be apparent that various different modifications can be made to the exemplary embodiments described herein without departing from the scope and spirit of this invention disclosure. When structures are identified as a means to perform a function, the identification is intended to include all structures, which can perform the function specified.

What is claimed is:

1. A method for draining water from a roof gutter while precluding entrance of debris into the gutter, comprising:

forming a ribbed support structure having a plurality of supporting ribs extending vertically from a bottom of the support structure, the support structure having a gutter lip side and an opposite roof side;

forming a lateral screen contact member at a top of the ribs, an end of the top of the ribs facing a roof side direction of the support structure, with upper and lower surfaces, the lower surface angled upward to form an acutely angled edge with the upper surface;

forming integral to the gutter lip side of the supporting structure, a gutter attachment member, the gutter attachment member having a roof side facing slot;

forming integral to the roof side of the supporting structure, a roof attachment member, the roof attachment member having a gutter lip side facing slot;

inserting a screen, having a plurality of apertures and sized to fit over the ribs, into the gutter attachment member's slot and roof attachment member's slot; and making contact between the screen and the upper surface of the contact members of the ribs.

2. The method of claim 1, wherein the plurality of supporting ribs are extended in a manner to trace an arc with their upper surfaces.

3. The method of claim 2, wherein a peak of the arc is off centered to a centerline of the bottom of the support structure.

4. The method of claim 1, further comprising forming a terminal end of the roof attachment member to have a downward or upward orientation, to enable the terminal end to be vertically attached to a side of a building.

5. The method of claim 1, further comprising forming a drip wall integrally extending downward from the gutter attachment member.

6. The method of claim 1, further comprising forming the bottom of the support structure to have an arc shape.

7. The method of claim 1, further comprising attaching the support structure with inserted mesh over gutter.

* * * * *